US010066873B2

(12) United States Patent
Saito et al.

(10) Patent No.: US 10,066,873 B2
(45) Date of Patent: Sep. 4, 2018

(54) COMBUSTION GAS EXTRACTION PROBE AND COMBUSTION GAS TREATMENT METHOD

(75) Inventors: Shinichiro Saito, Kumagaya (JP); Takahiko Suzuki, Kumagaya (JP)

(73) Assignee: Taiheiyo Cement Corporation, Tokyo (JP)

( * ) Notice: Subject to any disclaimer, the term of this patent is extended or adjusted under 35 U.S.C. 154(b) by 2433 days.

(21) Appl. No.: 10/579,327

(22) PCT Filed: Nov. 16, 2004

(86) PCT No.: PCT/JP2004/016991

§ 371 (c)(1),
(2), (4) Date: Mar. 5, 2007

(87) PCT Pub. No.: WO2005/050114

PCT Pub. Date: Jun. 2, 2005

(65) Prior Publication Data

US 2011/0083745 A1 Apr. 14, 2011

(30) Foreign Application Priority Data

Nov. 18, 2003 (JP) ..... 2003-387441

(51) Int. Cl.
*F27D 17/00* (2006.01)
*F27B 7/38* (2006.01)
*F15D 1/08* (2006.01)

(52) U.S. Cl.
CPC ..... *F27D 17/001* (2013.01); *F15D 1/08* (2013.01); *F27B 7/38* (2013.01); *Y10T 137/0318* (2015.04); *Y10T 137/8766* (2015.04)

(58) Field of Classification Search
CPC ..... F15D 1/0055; F15D 1/0065; F15D 1/008; F15D 1/08; F27B 7/38
(Continued)

(56) References Cited

U.S. PATENT DOCUMENTS 3,332,442 A * 7/1967 Reed ..... 137/896
3,567,399 A * 3/1971 Altmann et al. ..... 422/183
(Continued)

FOREIGN PATENT DOCUMENTS

JP 2116649 5/1990
JP 9301751 11/1997

OTHER PUBLICATIONS

Machine Translation of JP 9301751.*

*Primary Examiner* — Kevin Murphy
(74) *Attorney, Agent, or Firm* — Stetina Brunda Garred and Brucker

(57) ABSTRACT

[Problems] A combustion gas extraction probe that is capable of preventing burnout of a head metal portion of a probe, capable of rapidly cooling a high-temperature gas in a uniform manner in a probe, and whose outer diameter can be kept small.

[Means for Solving Problems] A combustion gas extraction probe (4) having a hollow-cylindrical inner tube (4*a*) in which a high-temperature combustion gas flows, a hollow-cylindrical outer tube (4*b*) surrounding the inner tube (4*a*), a low-temperature gas discharge hole (4*c*) provided in the inner tube (4*a*), and a low-temperature gas supply means (9) for supplying a low-temperature gas between the inner tube (4*a*) and the outer tube (4*b*) and discharging the low-temperature gas from the discharge hole (4*c*) into the direction that is substantially perpendicular to the sucking direction of the high-temperature combustion gas and is toward the center of the flow of said high-temperature combustion gas. Alternatively, plural discharge holes (4*c*) may be provided, where the individual discharge holes (4*c*) are arranged at substantially the same positions from the head of the probe in the high-temperature combustion gas sucking direction, or alternatively, the discharge holes (4*c*) may be arranged in stages in the high-temperature combustion gas
(Continued)

sucking direction. The flow speeds of the low-temperature gas and the high-temperature combustion gas are preferably not less than 40 m/s and not more than 100 m/s.

12 Claims, 3 Drawing Sheets

(58) Field of Classification Search
USPC ..... 137/896; 110/203, 216; 366/148, 336; 432/72, 116, 117, 77
See application file for complete search history.

(56) References Cited

U.S. PATENT DOCUMENTS

| | | | | | |
|---|---|---|---|---|---|
| 3,594,109 | A | * | 7/1971 | Penny | 60/800 |
| 3,934,408 | A | * | 1/1976 | Irwin | 60/753 |
| 4,150,817 | A | * | 4/1979 | Regelin et al. | 266/139 |
| 5,526,386 | A | * | 6/1996 | Tsiklauri et al. | 376/317 |
| 5,687,572 | A | * | 11/1997 | Schrantz et al. | 60/753 |
| 5,793,831 | A | * | 8/1998 | Tsiklauri et al. | 376/317 |
| 5,937,771 | A | * | 8/1999 | Sutoh et al. | 110/345 |
| 6,017,213 | A | * | 1/2000 | Murata et al. | 432/116 |
| 2002/0086258 | A1 | * | 7/2002 | Hansen et al. | 432/103 |

* cited by examiner

【FIG. 1】
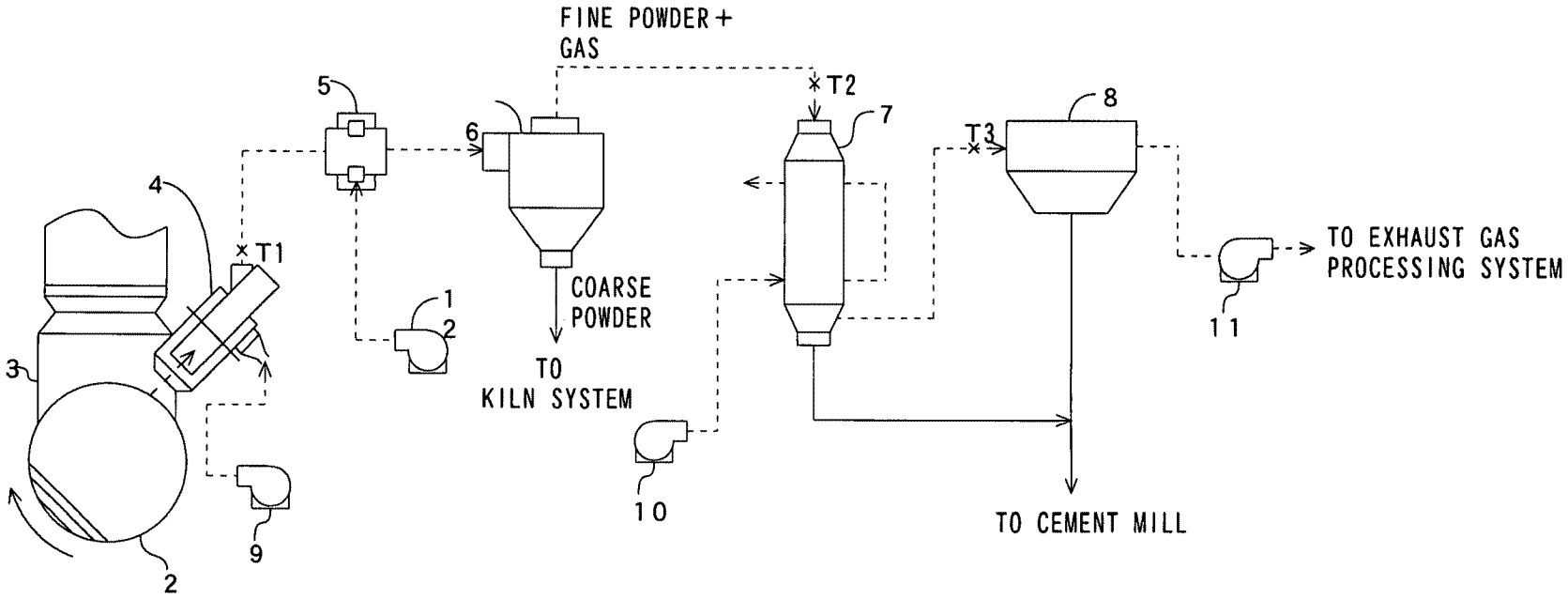

【FIG. 2】
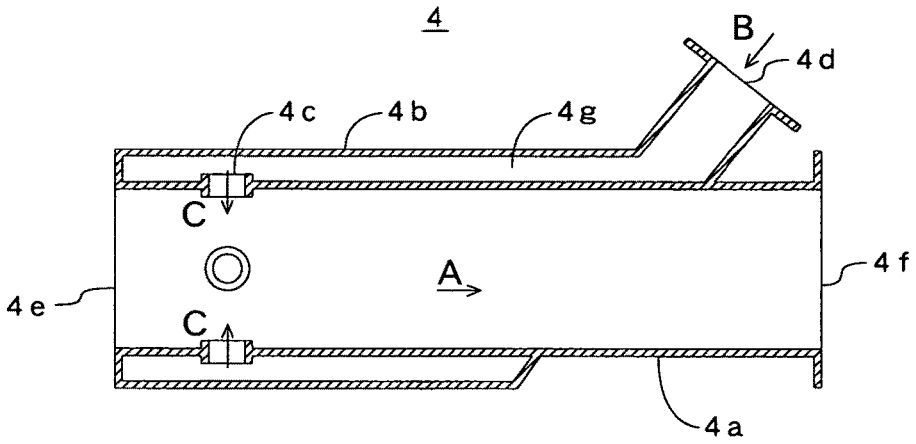
【FIG. 3】
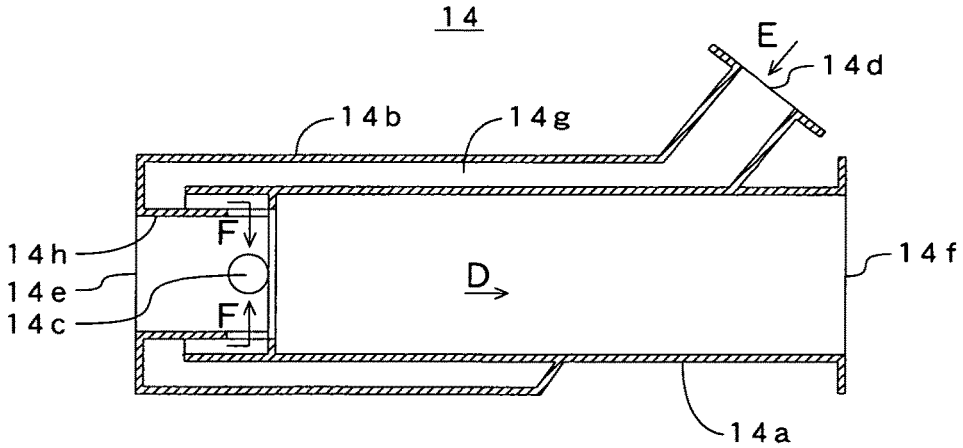

【FIG. 4】
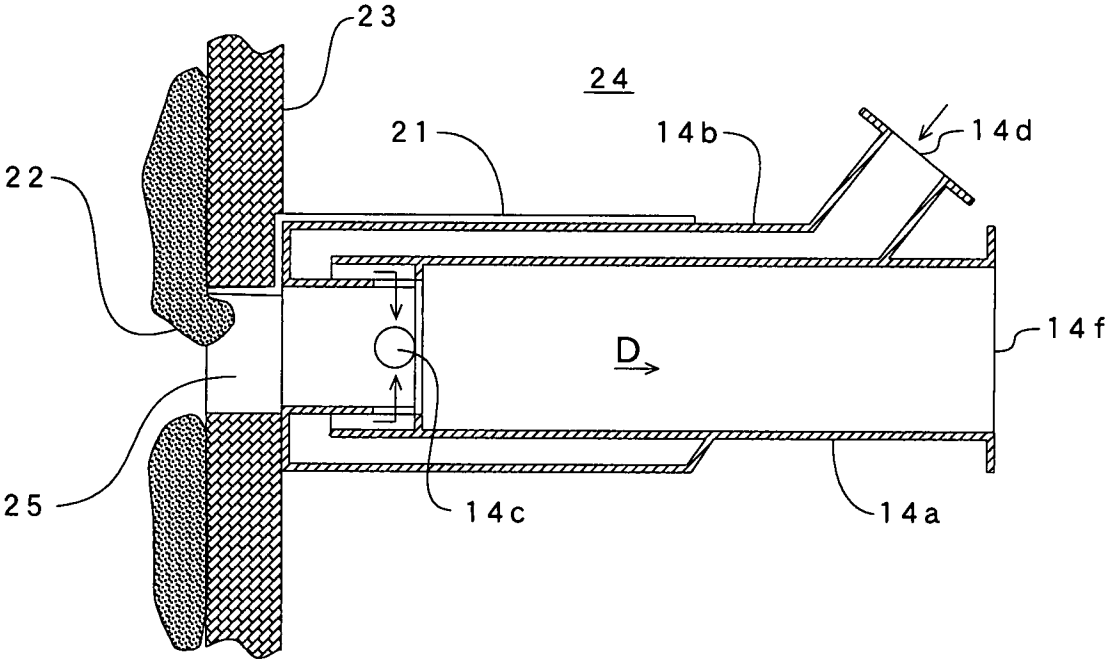

COMBUSTION GAS EXTRACTION PROBE AND COMBUSTION GAS TREATMENT METHOD

PRIORITY DATA

The present application claims priority to International Application No. PCT/JP2004/016991 which was filed on Nov. 16, 2004 and which claims priority to Japanese Patent Application No. 2003-387441 filed Nov. 18, 2003.

TECHNICAL FIELD

The present invention relates to a combustion gas extraction probe and a combustion gas treatment method, and more particularly to a combustion gas extraction probe and a combustion gas treatment method used for a cement kiln chlorine bypass system, for instance, which bleeds a kiln exhaust gas passage, which runs from the end of the cement kiln to a bottom cyclone, of a part of the combustion gas to remove chlorine.

BACKGROUND ART

It is noticed that chlorine, sulfur, alkali and the like cause troubles such as preheater clogging in cement plants, and especially chlorine exerts the most harmful effect, so that a cement kiln chlorine bypass system that bleeds a kiln exhaust gas passage, which runs from the end of a cement kiln to a bottom cyclone, of a part of the combustion gas to remove chlorine is used. And, the quantity of the chlorine carried into a cement kiln increases with the increase in the amount of practical use of chlorine-content recycled resources in recent years, and increase of the capability of chlorine bypass system is inescapable.

In the chlorine bypass system, in order to extract a part of combustion gas from a portion near an entrance hood, a probe protrudes near the entrance hood and an extracted gas disposal equipment is installed in the rear stage of this probe. Since it is exposed to high temperature circumstance at approximately 1000° C. near the entrance hood, steel casting with high degree of heat resistance needs to be used for the head of this probe, or it is necessary to cool the head with cooling air taken in from the outside of the entrance hood to protect the probe.

Further, since volatile components, such as chlorine in a kiln exhaust gas is condensed to fine powder portion of bypass dust by carrying out rapid cooling to approximately 450° C. or less with the probe, a classification means such as a cyclone is arranged to a gas extraction and discharge equipment in the rear stage, and bypass dust is classified into coarse powder dust with low volatile component concentration and fine powder dust with high volatile component concentration, and the coarse powder dust is returned to a kiln system, and only fine powder dust is discharged out of the system through the chlorine bypass system to reduce the quantity of the bypass dust. Therefore, it is required to carry out rapid cooling of the kiln exhaust gas in the probe also from this point.

From the above-mentioned point of view, in the first patent document, for example, a technique is described, in which an air cooling box construction made of double tubes with many air jet holes is provided, and the entrance of the air is formed in the tangential direction of an outside tube, and the air jet holes are arranged slant so that exhaust gas flow may turn into a swirl flow.

Further, in the second patent document, a technique is described, in which in order to efficiently carry out rapid cooling of exhaust gas from a kiln bypass, a probe of double-tube structure is continued to a kiln exhaust gas passage, and a part of the kiln exhaust gas is extracted through an inner tube of this probe, and cooling gas is supplied to a fluid passage between the inner tube and an outer tube of the probe, and the cooling gas is guided to inside of a head portion of the inner tube to form a mixed rapid cooling region in a head portion of the probe.

Patent document 1: Japanese Patent Publication Heisei 11-130489 gazette (FIGS. 2 to 4)

Patent document 2: Japanese Patent Publication Heisei 11-35355 gazette (FIG. 2)

DISCLOSURE OF THE INVENTION

Problems to be Solved by the Invention

However, in the conventional combustion gas extraction probe, burnout of the metal fitting at the head of the probe causes cooling air to be inhaled in the kiln without being used for cooling, and there was a problem that the sucking of the high-temperature combustion gas becomes impossible.

And, in an extraction portion described in the first patent document, many air injection holes are arranged to be slant so that the flow of the exhaust gas becomes a swirl flow, which causes cooling air injected from the injection holes to unevenly be distributed to outside of the exhaust gas. As a result, in the temperature distribution in a perpendicular portion to the direction of the exhaust gas flow, a hot section is unevenly distributed in the central portion, and there was a possibility that rapid cooling of the kiln exhaust gas could not be carried out uniformly in the probe.

Further, as described above, in order to cope with the increase in the amount of chlorine carried into cement kilns, it is necessary to reinforce the capability of chlorine bypass system to extract more kiln exhaust gas and to remove more chlorine. However, when the construction of the probe described in the second patent document is used as it is, the diameter of the probe becomes large, and in consideration that the passage of the kiln exhaust gas flow is narrow and various equipment for waste treatment exists at the entrance hood, it becomes difficult to install a large-scale probe at the entrance hood, so that the diameter of the probe is needed to be held small.

The present invention has been made in consideration of the above problems in the conventional art, and the object thereof is to provide a combustion gas extraction probe that is able to prevent burnout of the metal fitting at the head of the probe and to carry out rapid cooling of the kiln exhaust gas or the like uniformly in the probe and to held the outer diameter small and so on.

Means for Solving Problems

To achieve the above object, the present invention is characterized in that in a combustion gas extraction probe for extracting a high-temperature combustion gas while cooling the high-temperature combustion gas with a low-temperature gas, the low-temperature gas is made to flow in a direction that is substantially perpendicular to a sucking direction of the high-temperature combustion gas and is toward a center of a flow of the high-temperature combustion gas for mixed cooling.

With the present invention, since the low-temperature gas flows in the direction that is substantially perpendicular to the sucking direction of the high-temperature combustion gas and is toward the center of the flow of the high-temperature combustion gas, the low-temperature gas with a certain momentum reaches to the central portion of the flow of the high-temperature combustion gas, and is efficiently mixed with the high-temperature combustion gas, which allows the high-temperature combustion gas to be cooled efficiently and rapidly while uniformly maintaining temperature distribution in a perpendicular section to the direction of the flow of the combustion gas. Further, the conventional probe shown in the second patent document had a possibility the low-temperature gas flew into the kiln side from the head of the probe when the speed of the gas was high. However, in this invention, the low-temperature gas has no velocity vector ingredient in a direction opposite to the flow of the combustion gas, which allows the low-temperature gas to be made high-speed. With this, the velocity of the low-temperature gas between the inner and outer tubes to be raised to a permissible limit of the pressure loss accompanying the increase in the flow velocities, which holds the outer diameter of the probe small.

The combustion gas extraction probe may be constructed to have an inner tube in which the high-temperature combustion gas flows; an outer tube surrounding the inner tube; a low-temperature gas discharge hole provided in the inner tube; and a low-temperature gas supply means for supplying the low-temperature gas between the inner tube and the outer tube, and discharging the low-temperature gas from the discharge hole into the direction that is substantially perpendicular to the sucking direction of the high-temperature combustion gas and is toward the center of the flow of the high-temperature combustion gas.

The combustion gas extraction probe may be constructed to have an inner tube in which the high-temperature combustion gas flows; an outer tube surrounding the inner tube and having a folded portion to cover a head of the inner tube; a low-temperature gas discharge hole provided at a portion of the folded portion, the portion of the folded portion facing the high-temperature combustion gas; and a low-temperature gas supply means for supplying the low-temperature gas between the inner tube and the outer tube, and discharging the low-temperature gas from the discharge hole into the direction that is substantially perpendicular to the sucking direction of the high-temperature combustion gas and is toward the center of the flow of the high-temperature combustion gas. With this probe, the head portion of the probe that is exposed to the highest temperature can be protected, and the life of the probe can be lengthened further.

In the combustion gas extraction probe, plurality of the low-temperature gas discharge holes may be provided, and individual discharge holes may be rotationally symmetrically arranged at substantially the same positions from a head of the probe in the high-temperature combustion gas sucking direction, or plurality of the low-temperature gas discharge holes can be arranged in stages from the head of the probe in the high-temperature combustion gas sucking direction.

In the combustion gas extraction probe, speeds of the low-temperature gas and the high-temperature combustion gas can be not less than 40 m/s and not more than 100 m/s. When the flow velocities are less than 40 m/s, the diameter of the probe will become too large, and when the flow velocities are more than 100 m/s, pressure loss of the probe itself and between the inner tube and the outer tube will become excessive, therefore, it is not desirable.

It is possible to provide a blaster injecting compressed air in an opposite direction to the sucking direction of the high-temperature combustion gas at the head of the probe. This prevents blockages of the probe at the inlet portion by blocks adhering to the surface of the wall of the exhaust gas flow passage to which the probe is installed.

In addition, the present invention is a combustion gas treatment method using one of the combustion gas extraction probes described above characterized in that regardless of the amount of the high-temperature combustion gas extracted, the amount of the low-temperature gas discharged is substantially uniformly maintained, and cooling gas is mixed again between an exit of the probe and an extracted gas disposal equipment in the rear stage of the probe to adjust the combustion gas to a predetermined temperature. With this method, high cooling rate is maintained to continuously generate micro crystallite of KCl, and performance of the chlorine bypass system of collecting a little high-concentration dust can be maintained.

Effect of the Invention

As described above, with the present invention, it is possible to provide combustion gas extraction probes which can maintain performance thereof without damaging by fire over a long period of time, and carry out rapid cooling of the high-temperature gas such as a kiln exhaust gas uniformly in the probe, while keeping the outer diameter small and so on.

THE BEST MODE TO CARRY OUT THE INVENTION

Next, embodiments of the present invention will be explained with reference to drawings. In the following explanation, the combustion gas extraction probe (hereafter referred to as "probe" for short) and the combustion gas treatment method according to the present invention will be explained in case that they are exemplarily applied to the chlorine bypass system of a cement kiln.

As shown in FIG. 1, a rising portion 3 which constitutes a part of a flow passage of exhaust gas from a cement kiln 2 is connected near an entrance hood of the cement kiln 2 of cement burning equipment, and a probe 4 for attracting high-temperature combustion gas to this rising portion 3 protrudes on it. In the rear stage of this probe 4, a secondary mixing chamber 5, a cyclone 6, a heat exchanger 7, a bag filter 8 and so on are arranged to constitute a chlorine bypass system 1.

FIG. 2 shows the first embodiment of the combustion gas extraction probe according to this invention, and the probe 4 comprises: a hollow-cylindrical inner tube 4*a* through which high-temperature combustion gas flows in the direction of arrow A; a hollow-cylindrical outer tube 4*b* which surrounds the inner tube 4*a;* plurality (four in this figure) of low-temperature gas injection holes 4*c;* a cooling air passage 4*g* formed between the inner tube 4*a* and the outer tube 4*b;* and a cooling air supply portion 4*d* for feeding low-temperature gas from a fan 9 (shown in FIG. 1) as a low-temperature gas supply means to the cooling air passage 4*g*.

The inner tube 4*a* is formed cylindrical and is provided with an inlet portion 4*e* of the high-temperature combustion gas, and an outlet portion 4*f*. The inlet portion 4*e* of the combustion gas is inserted in the rising portion 3 of the cement kiln 2, and the outlet portion 4*f* is connected to the gas disposal equipment in the rear stage.

The outer tube 4*b* is formed cylindrical with a section of a concentric circle so that the outer tube 4*b* may surround the inner tube 4*a*. The outer tube 4*b* is provided with the cooling air supply portion 4*d* for drawing the cooling air from the cooling fan 9 into the probe 4, and the space between the outer tube 4*b* and the inner tube 4*a* serves as the cooling air passage 4*g*, which is closed at the head portion of the probe 4. On the peripheral portion of the outer tube 4*b* is installed fire-resistant material not shown. In the above-mentioned embodiment, although the inner tube 4*a* and the outer tube 4*b* are formed cylindrical, it is not limited circularly but section shapes of the inner tube 4*a* and the outer tube 4*b* can also be the shape of a rectangle, or a polygon.

Plurality of discharge holes 4*c* are provided, and individual discharge holes 4*c* are arranged at substantially the same positions from the inlet portion 4*c* of the inner tube 4*a* in the direction that the high-temperature combustion gas flows (the direction of arrow A), that is, the axial direction of the inner tube 4*a*, from these low-temperature gas injection holes 4*c*, cooling air introduced by the cooling fan 9 is breathed out in the direction that is substantially perpendicular to the sucking direction of the high-temperature combustion gas and is toward the center of the flow of the high-temperature combustion gas (the direction of arrow C). As is apparent from FIG. 2, the discharge holes 4*c* are each disposed about respective axes aligned within a common plane for emitting low temperature gas in a single plane, thereby creating a single plane, i.e., sheet or curtain, of low-temperature gas. Although the number of discharge holes 4*c* is four in FIG. 2, it is preferred to provide two to six.

Next, operation of the probe 4 with the above-mentioned construction will be explained with reference to FIGS. 1 and 2.

A part of kiln exhaust gas of approximately 1000° C. that is generated in the cement kiln 2 is extracted with the probe 4. In this case, the cooling air from the cooling fan 9 is supplied to the probe 4 through the cooling air supply portion 4*d*, and the cooling air is introduced in the inner tube 4*a* from the discharge holes 4*c* through the cooling air passage 4*g*, and is mixed with the combustion gas by the probe 4. This rapidly cools the high-temperature combustion gas so that the outlet gas temperature T1 of the probe 4 may become approximately 450° C. Here, the outlet gas temperature T1 is set to be approximately 450° because KCl and the like becomes to have adhesion when it exceeds approximately 450°. Further, the extracted gas cooled with the probe 4 is cooled again in the secondary mixing chamber 5 by a secondary cooling fan 12, which is controlled so that the entrance temperature T2 of a heat exchanger 7 becomes approximately 350° C.

When cooling the high-temperature combustion gas from the above-mentioned cement kiln 2, with the probe 4 according to the present invention, the cooling air that flows in the inner tube 4*a* from the discharge holes 4*c* flows in the direction that is substantially perpendicular to the sucking direction of the high-temperature combustion gas and is toward the center of the flow of the high-temperature combustion gas with a certain amount of momentum, so that the low-temperature gas reaches to the central portion of the flow of the high-temperature combustion gas, and is mixed with the high-temperature combustion gas, which rapidly cools the high-temperature combustion gas. In addition, the low-temperature gas has no velocity vector ingredient in a direction opposite to the flow of the combustion gas, so that exhaust gas from the cement kiln 2 that is not extracted is not cooled by the cooling air, which allows the low-temperature gas to be made high-speed and allows the velocity of the cooling air between the inner and outer tubes to be raised to a permissible limit of the pressure loss accompanying the increase in the flow velocities. As a result, the outer diameter of the probe can be held small.

Then, the extracted gas containing dust from the secondary mixing chamber 5 is classified by the cyclone 6. And, coarse powder is returned to a rotary kiln system, and fine powder and combustion gas are supplied to the heat exchanger 7 and heat exchange is carried out by the cooling air from the fan 10, and then the dust is collected with the bag filter 8, and they are returned to an exhaust gas processor through the fan 11. Here, the gas volume induced by the fan 10 is controlled so that the entrance temperature T3 of the bag filter becomes approximately 150° C. Further, the dust with high chlorine content that is collected with the heat exchanger 7 and the bag filter 8 may be added to a cement mill system, or processed out of the system. It is also possible by introducing cooling air by the secondary cooling fan 12 so that the outlet gas temperature of the secondary mixing chamber 5 may become approximately 150° C. to make the heat exchanger 7 unnecessary.

Next, the second embodiment of the combustion gas extraction probe according to this invention will be explained with reference to FIG. 3.

This probe 14 comprises: a hollow-cylindrical inner tube 14*a* in which high-temperature gas flows in the direction of arrow D; an outer tube 14*b* surrounds the inner tube 14*a*, and is provided with, at a head portion, a folded portion 14*h* covering a head portion of the inner tube 14*a;* plurality of low-temperature gas discharge holes 14*c* provided on the folded portion 14*h* facing the high-temperature combustion gas; and a cooling air passage 14*g* formed between the inner tube 14*a* and the outer tube 14*b;* and a cooling air supply portion 14*d* for supplying the low-temperature gas from the cooling fan 9 (illustrated in FIG. 1) as a low-temperature gas supply means to the cooling air passage 14*g*.

Since the main structural elements of this probe 14 are the same as those of the probe 4 shown in the above FIG. 2, detailed explanation for the elements will be omitted. In this embodiment, the head portion of the inner tube 14*a* is covered by the folded portion 14*h* of the outer tube 14*b*, so that the cooling air passing the cooling air passage 14*g* may turn around the inside of the head portion of the outer tube 14*b*, which allows the head portion of the outer tube 14*b* exposed to high temperature to be protected, and lengthens the life of the probe.

Next, the third embodiment of the combustion gas extraction probe according to this invention will be explained with reference to FIG. 4.

This probe 24 is characterized by adding a blaster 21 to remove blocks at a suction opening of the probe 14 through compressed air to the probe 14 in the second embodiment. The probes 4 and 14 according to the present invention shown in FIGS. 2 and 3 are characterized in that the outer diameters of the probes 4 and 14 are held small as a feature. In connection with this, there is a possibility that the inlet portion of probes 4 and 14 may blockade by the blocks adhering to the surface of a wall of the kiln exhaust gas passage in which probes 4 and 14 are installed, so that the blaster 21 is installed. In FIG. 4, about the same structural elements as the probe 14 shown in FIG. 3, the same reference numbers are attached and detailed explanation is omitted.

The blaster 21 is introduced in the kiln exhaust gas passage through a vertical wall 23 of the rising portion 3 (refer to FIG. 1) from the upper portion of the outer tube 14*b*.

When removing the block 22 at the probe suction opening 25, after shutting the extracted gas suction damper not shown (a damper being provided in the rear stage of the combustion gas exit portion 14*f* and making the high-temperature combustion gas flow in the direction of arrow D), and decreasing the quantity of cooling air automatically by temperature control of the extracted gas, compressed air is blown from the blaster 21 to remove the block 22. After removing the block 22, the extracted gas suction damper is opened and it returns to usual operation.

The timing performing the block removal using the above blaster 21 is judged by the fall of the pressure at the outlet of the probe 24, the fall of the current of the fan (refer to FIG. 1) and so on. In case that the discharge mouth 14*c* blocked by the blocks removed by the blaster 21, a lattice can be installed at the low-temperature gas discharge holes 14*c*.

In the above-mentioned embodiment, although two or more discharge holes 4*c* and 14*c* have been arranged in the sucking direction of the high-temperature combustion gas from the head of the probes 4, 14, and 24 at substantially the same positions, it may be made to arrange these plurality of discharge holes 4*c* and 14*c* over two or more stages from the head of the probes 4, 14, and 24 in the suction direction of the high-temperature combustion gas.

Further, it is also possible to add exhaust gas that contains bad smell generated by processing of sludge and the like to the air as gas for cooling, and to perform simultaneously cooling of the high-temperature combustion gas and bad smell processing.

Still further, in the above-mentioned embodiment, although the combustion gas extraction probe and the combustion gas treatment method according to the present invention are explained taking the case where applied to the chlorine bypass system of a cement kiln, the probe and the method of this invention are applicable to not only the chlorine bypass but the alkali bypass of a cement kiln or the like and combustion furnaces other than a cement kiln etc.

BRIEF EXPLANATION OF DRAWINGS

FIG. 1 A flowchart showing a chlorine bypass system using the combustion gas extraction probe according to this invention.

FIG. 2 A sectional view showing the first embodiment of the combustion gas extraction probe of this invention.

FIG. 3 A sectional view showing the second embodiment of the combustion gas extraction probe of this invention.

FIG. 4 A sectional view showing the third embodiment of the combustion gas extraction probe of this invention.

EXPLANATION OF SIGNALS

1 chlorine bypass system
2 cement kiln
3 rising portion
4 probe
4*a* inner tube
4*b* outer tube
4*c* discharge hole
4*d* cooling air inlet portion
4*e* combustion gas inlet portion
4*f* combustion gas exit portion
4*g* cooling air passage
5 secondary mixing chamber
6 cyclone
7 heat exchanger
8 bag filter
9 cooling fan
10 fan
11 fan
12 secondary cooling fan
14 probe
14*a* inner tube
14*b* outer tube
14*c* discharge hole
14*d* cooling air inlet portion
14*e* combustion gas inlet portion
14*f* combustion gas exit portion
14*g* cooling air passage
14*h* folded portion
21 blaster
22 block
23 vertical wall
24 probe
25 probe suction opening

The invention claimed is:

1. A combustion gas extraction probe for extracting a high-temperature combustion gas while cooling said high-temperature combustion gas with a low-temperature gas characterized by:

an outer tube; and a metal inner tube positioned within the outer tube to define a cooling fluid passage therebetween, the metal inner tube being of unitary construction and having an inner diameter defining a flow path area substantially along the entire tube and through which extracted high-temperature combustion gas flows, the metal inner tube configured to emit low-temperature gas into the flow path area only in a single transverse plane generally perpendicular to a sucking direction of the high-temperature combustion gas, the inner tube having a plurality of low-temperature discharge holes in direct fluid communication with the cooling fluid passage and the flow path area and spaced from a sucking end of the inner tube and disposed about respective axes aligned within a single plane for emitting said low-temperature gas so as to flow in a direction that is substantially perpendicular to the sucking direction of the high-temperature combustion gas and is toward a center of a flow of said high-temperature combustion gas such that said low-temperature gas reaches the centermost portion of said high-temperature combustion gas to create a single transverse sheet of low-temperature gas for mixed cooling and that all vector components of said low-temperature gas emitted into the high-temperature gas and parallel to the flow direction of said high-temperature gas are in a downstream direction of the high-temperature combustion gas; and a plurality of collars coupled to the inner tube and disposed about respective ones of the plurality of low-temperature discharge holes, each collar being disposed about a respective axis which is perpendicular to the sucking direction of the high-temperature combustion gas;

the inner tube being independent of a discharge hole disposed about an axis spaced from the single plane and arranged perpendicular to the inner tube.

2. The combustion gas extraction probe as claimed in claim 1 comprising:

a low-temperature gas supply means for supplying the low-temperature gas between the inner tube and the outer tube, and discharging the low-temperature gas from the discharge hole into the inner tube;

the inner tube being connected to the outer tube such that all of the low-temperature gas flowing in the inner tube passes through the plurality of low-temperature gas discharge holes.

3. The combustion gas extraction probe as claimed in claim 2, wherein individual discharge holes are rotationally symmetrically arranged at substantially the same positions from a head of the probe in the high-temperature combustion gas sucking direction.

4. The combustion gas extraction probe as claimed in claim 2, wherein the outer tube defines a closed end.

5. The combustion gas extraction probe as claimed in claim 4, wherein the inner tube defines an open end through which the high-temperature combustion gas enters the inner tube.

6. The combustion gas extraction probe as claimed in claim 5, wherein the closed end of the outer tube circumnavigates the open end of the inner tube.

7. The combustion gas extraction probe as claimed in claim 2, wherein:

the inner tube terminates to define an inner entrance end through which the high-temperature gas enters the inner tube, the inner entrance end defining an inner entrance plane; and the inner and outer tubes are configured such that the low-temperature gas does not traverse the inner entrance plane.

8. The combustion gas extraction probe as claimed in one of claims 1-2 and 3, wherein flow speeds of the low-temperature gas and the high-temperature combustion gas are not less than 40 m/s and not more than 100 m/s.

9. The combustion gas extraction probe as claimed in one of claims 1 and 3, characterized by having a blaster injecting compressed air in an opposite direction to the sucking direction of the high-temperature combustion gas at a head of the probe.

10. The combustion gas extraction probe as claimed in claim 1, wherein the low-temperature gas is emitted along at least two intersecting axes.

11. The combustion gas extraction probe as claimed in claim 10, wherein the low-temperature gas is emitted along at least two perpendicular axes.

12. The combustion gas extraction probe as claimed in claim 1, wherein the low-temperature gas is emitted into the high-temperature combustion gas to cool a peripheral portion of the high-temperature combustion gas as well as a central portion of the high-temperature combustion gas.

* * * * *